US005709643A

United States Patent [19]

Borgström et al.

[11] Patent Number: 5,709,643

[45] Date of Patent: Jan. 20, 1998

[54] CENTRIFUGAL SEPARATOR FOR ENTRAINING A SEPARATED LIQUID WITH MINIMAL AIR MIXTURE

[75] Inventors: Leonard Borgström, Tyresö ; Hans Moberg, Stockholm; Claes-Göran Carlsson, Tullinge; Torgny Lagerstedt, Stockholm; Olle Nåbo, Tullinge; Claes Inge, Saltsjö-Duvnäs; Peter Franzén, Tullinge, all of Sweden

[73] Assignee: Alfa Laval Separation AB, Tumba, Sweden

[21] Appl. No.: 556,914

[22] PCT Filed: May 19, 1994

[86] PCT No.: PCT/SE94/00467

§ 371 Date: Mar. 22, 1996

§ 102(e) Date: Mar. 22, 1996

[87] PCT Pub. No.: WO94/27727

PCT Pub. Date: Dec. 8, 1994

[30] Foreign Application Priority Data

May 21, 1993 [SE] Sweden ..... 9301742

[51] Int. Cl.[6] ..... B04B 1/08; B04B 11/08

[52] U.S. Cl. ..... 494/56; 494/70

[58] Field of Search ..... 494/56, 57, 68–70, 494/85

[56] References Cited

U.S. PATENT DOCUMENTS

| | | | |
|---|---|---|---|
| 2,435,623 | 2/1948 | Forsberg | 494/56 X |
| 5,518,494 | 5/1996 | Borgstrom et al. | 494/56 |
| 5,599,271 | 2/1997 | Eiken | 494/70 X |

FOREIGN PATENT DOCUMENTS

| | | |
|---|---|---|
| 113505 | 3/1945 | Sweden . |
| 88-96974 | 8/1987 | U.S.S.R. . |
| 90-230257 | 1/1990 | U.S.S.R. . |
| 2189172 | 10/1987 | United Kingdom . |
| WO A1 | | |
| 89/03250 | 4/1989 | WIPO . |

*Primary Examiner*—Charles E. Cooley

*Attorney, Agent, or Firm*—Fish & Richardson P.C.

[57] ABSTRACT

Centrifugal separator comprising a rotor which inside itself forms an inlet chamber (16), a separation chamber (5) and an outlet chamber (12). The outlet chamber (12) is connected to the separation chamber (5) via a passage (13) through which a liquid separated during operation flows into the outlet chamber (12) and in the same forms a rotating liquid body with a radially inwardly directed free liquid surface (14). The outlet chamber is provided with an outlet (19), which is located radially outside the free liquid surface (14). In the outlet chamber (12) at least two wall elements (22) are arranged fixedly connected to the rotor and arranged to form a channel between themselves in order to during operation entrain the separated liquid into the rotation of the rotor and at the same time admit flow of the same radially outwardly in the outlet chamber (12). To make an effective entrainment possible without a great risk of air admixture the wall elements (22) have a portion, which extends radially between the radial level at which the free liquid surface (14) is located and a level radially outside the outlet (19), and which has a directional component in the circumferential direction, which seen radially outwardly is directed forwardly in the rotational direction.

22 Claims, 3 Drawing Sheets

CENTRIFUGAL SEPARATOR FOR ENTRAINING A SEPARATED LIQUID WITH MINIMAL AIR MIXTURE

FIELD OF THE INVENTION

The present invention concerns a centrifugal separator comprising a rotor, which is rotatable around a rotational axis and inside itself forms an inlet chamber for the liquid to be centrifugally treated, a separation chamber, which is connected to the inlet chamber, and an outer chamber, which via a passage communicates with the separation chamber for the reception of a liquid separated during operation in the separation chamber, and which is so designed that a liquid present therein during operation forms a rotating liquid body with a radially inwardly directed free liquid surface. The outlet chamber is provided with an outlet, which is located radially outside the free liquid surface. In the outlet chamber at least two wall elements extending radially and axially are arranged fixedly connected to the rotor and arranged to form a channel them between to entrain during operation the separated liquid into the rotation of the rotor and at the same time admit a flow of the same radially outwardly in the outlet chamber.

BACKGROUND OF THE INVENTION

In a known centrifugal separator of this kind the outlet chamber is separated from the separation chamber by means of a dividing wall, through which the passage is so arranged that it opens radially inside the free liquid surface. The outlet, which is connected to the outlet chamber, is in the known centrifugal separator formed in a stationary disc shaped outlet device, which has a portion arranged in the outlet chamber, which has internal channels, with which it extends from a central portion of the outlet chamber radially outwards to the portion of the outlet chamber, in which the rotating liquid body is located during operation. In this centrifugal separator also radially wings having an axial and radial extension are arranged in the outlet chamber fixedly connected to the dividing wall to entrain the separated liquid located in the outlet chamber into the rotation of the rotor.

The liquid present in the outlet chamber then will be in contact with the entraining wings and in contact with the portion of the stationary outlet device, which extends radially outside the free liquid surface of the rotating liquid body. Thereby the outlet device slows down the rotation of the liquid body while the wings entrain the liquid body into the rotation of the rotor. Thus, different portions of the liquid body obtain different rotation speeds and are influenced by different centrifugal forces. This results in an internal circulation in the outlet chamber, the separated liquid flowing radially inwardly along the outside of the outlet device and radially outwardly along the wings. The flow speed of the liquid at the free liquid surface can be considerable, which results in a great risk for air or another gas, which is located radially inside and in contact with the free liquid surface in the outlet chamber, to be admixed in the separated liquid and be entrained in its flow along the wings and further out through the internal channels in the outlet device.

As a consequence of the fact that the passage through the dividing wall opens into the outlet chamber radially inside the free liquid surface the risk for air admixture increases as a result of the collision taking place when the separated liquid entering into the outlet chamber is thrown out by the centrifugal force from the passage radially outwardly towards either the free liquid surface or the wings in the outlet chamber.

In order to entrain the separated liquid in the outlet chamber in a gentle manner it has, as shown in WO 89/03250 A1, been suggested in a centrifugal separator of this kind to design the entraining members in the shape of at least one disc fixedly connected to the rotor. Hereby, the radially outwardly directed flow is distributed in large layers, whereby the flow speeds at the free liquid surface become lower and the risk of air admixture becomes lower. However, it shows that the capability of the discs to entrain the separated liquid in the outlet chamber into the rotation of the rotor often is insufficient.

SUMMARY OF THE INVENTION

The object of the present invention is to accomplish a centrifugal separator of the kind initially described, in which a separated liquid can be entrained gently but still effectively and be discharged out of the outlet chamber with a low risk of air admixture.

This is accomplished according to one aspect of the invention by providing a centrifugal separator of this kind with radially and axially extending wall elements, each of which has at least a portion, which extends radially between the radial level at which the free liquid surface is located and a level radially outside the outlet. Each portion of the wall has a directional component in this circumferentical direction, which seen radially outwardly is directed forwardly in the rotational direction.

The radially outer outwardly directed flow of separated liquid in the rotating liquid body from the free liquid surface towards the outlet is then mainly taking place along the rear wall element of the two wall elements forming the channel seen in the rotational direction.

Advantageously, the portions of the wall elements are curved according to the invention in a plane perpendicular to the rotation axis and have a directional component in the circumferential direction that increases with increasing radius.

The wall elements according to the invention can be arranged directly on the dividing wall but can also be arranged at an axial distance from it in a way such that an annular gap surrounding the rotational axis is formed between this dividing wall and the wall elements. An angular baffle surrounding the rotational axis is then suitably arranged in the outlet chamber extending radially outwardly from the passage out into the gap, to conduct the separated liquid flowing into the outlet chamber radially outwardly in the gap towards the free liquid surface.

In another embodiment of the invention the channel has a cross section, which axially in a direction towards the outlet is open towards the outlet chamber.

In a further embodiment of the invention, the wall elements have a first axial side facing in a first direction towards the dividing wall and a second axial side facing in a second direction opposite the first direction, a covering device being arranged in the outlet chamber fixedly connected to each one of the wall elements on the second axial side to delimit the channel towards the outlet chamber at the first side of the wall elements.

In the following paragraphs the invention will be described in greater detail with reference to the attached drawings, in which FIG. 1 schematically shows an axial section through a part of a centrifugal separator according to the invention, FIG. 2 schematically shows a section along the line II—II through a part of the centrifugal separator shown in FIG. 1, FIG. 3 schematically shows an axial section along the line III—III through the part shown in FIG. 2, and FIG. 4 schematically shows an axial section through a part of a centrifugal separator according to a modified embodiment of the invention.

DETAILED DESCRIPTION

Figure 1:
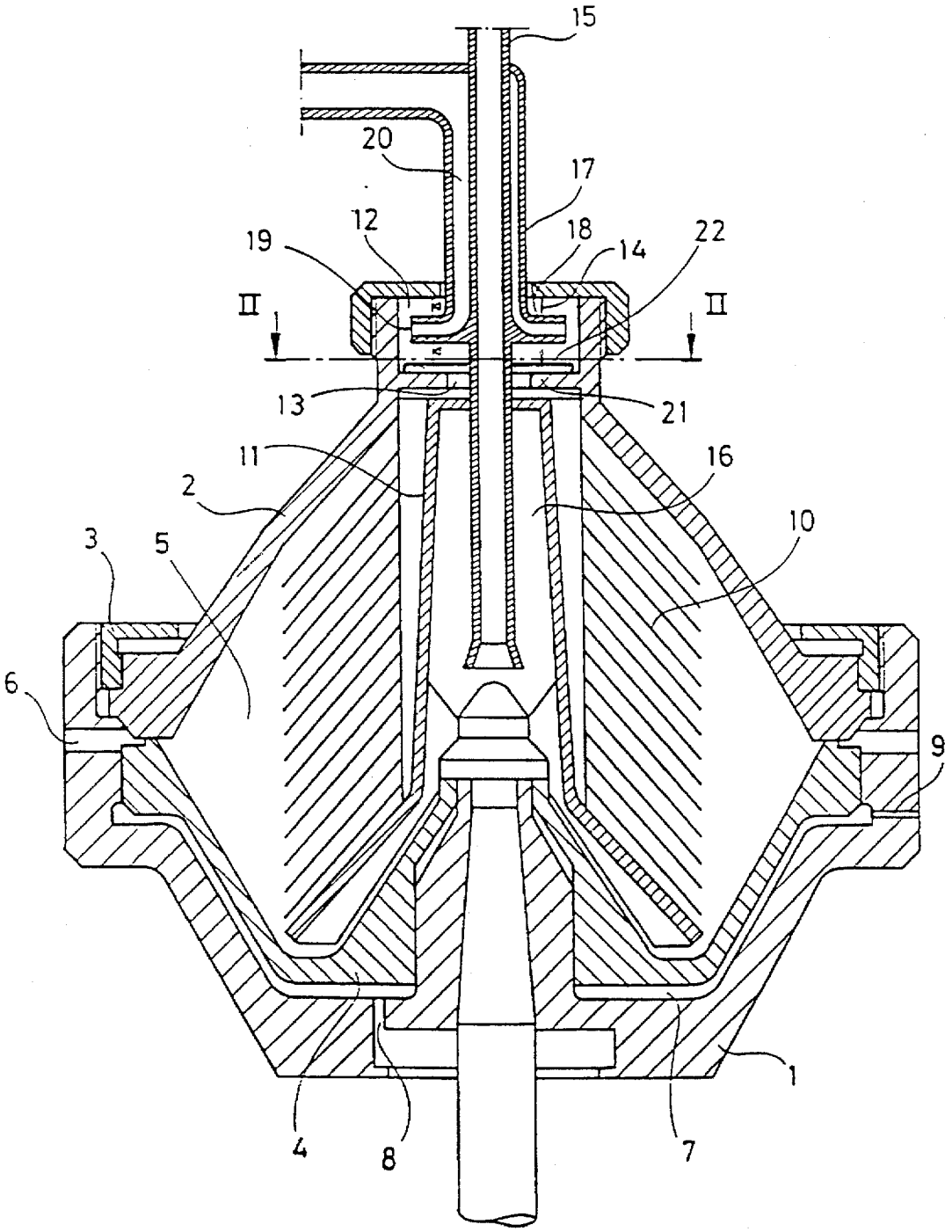

The part of a centrifugal separator according to the invention shown in FIG. 1 comprises a rotor, which has a lower part 1 and an upper part 2 which are joined together axially by means of a locking ring 3. Inside the centrifugal separator shown as an example there is arranged an axially movable valve slide 4. This valve slide 4 delimits together with the upper part 2 a separation chamber 5 and is arranged to open and close an annular gap towards peripheral outlet openings 6 for a substance, which during operation has been separated in the rotor and accumulated at the periphery of the separation chamber 5. The valve slide 4 delimits together with the lower part 1 a closing chamber 7, which is provided with an inlet 8 and a throttled outlet 9 for a closing liquid.

Inside the separation chamber 5 a disc stack 10 is arranged consisting of a number of conical separation discs between a distributor 11 and the upper part 2. The upper part 2 forms at its in upper end an outlet chamber 12, into which in this case a relatively light, separated liquid can flow from the separation chamber 5 via a central passage 13. The liquid present in the outlet chamber 12 during operation of the rotor forms a rotating liquid body having a radially inwardly free liquid surface 14.

Centrally through the outlet chamber 12 a stationary inlet tube 15 extends, which opens into an inlet chamber 16 in the interior of the distributor 11. Next to the inlet tube 15 a stationary outlet tube 17 is arranged for the specific lighter liquid in the chamber 12. An outlet device 18 is arranged in the chamber around the inlet tube 15 and connected to the outlet tube 17. The outlet device 18 is stationary, but an an alternative outlet arrangement a similar outlet device might be arranged to rotate with a speed, which is lower than the rotational speed of the rotor.

The outlet device 18 extends radially outwardly in the outlet chamber 12 and has a portion located outside the radial level of the free liquid surface 14. In the outlet device 18 is at least one outlet channel 20 arranged with an inlet opening, which is located in this portion and constitutes outlet 19 out of the outlet chamber 12. The outlet channel 20 is connected to the interior of the inlet tube 17.

In the embodiments shown in the figure the passage 13 is arranged centrally in a dividing wall 21. In the outlet chamber a number of wall elements distributed around the rotational axis are arranged, which between themselves form channels 23 (FIG. 2) in order during operation into the rotation of the rotor to entrain the separated liquid present in the outlet chamber 12 and conduct it radially outwardly towards the outlet 19. At least one portion of the wall elements 22 then extends radially between the radial level 14, at which the free liquid surface is located and a level radially outside the outlet 19.

Figure 2:
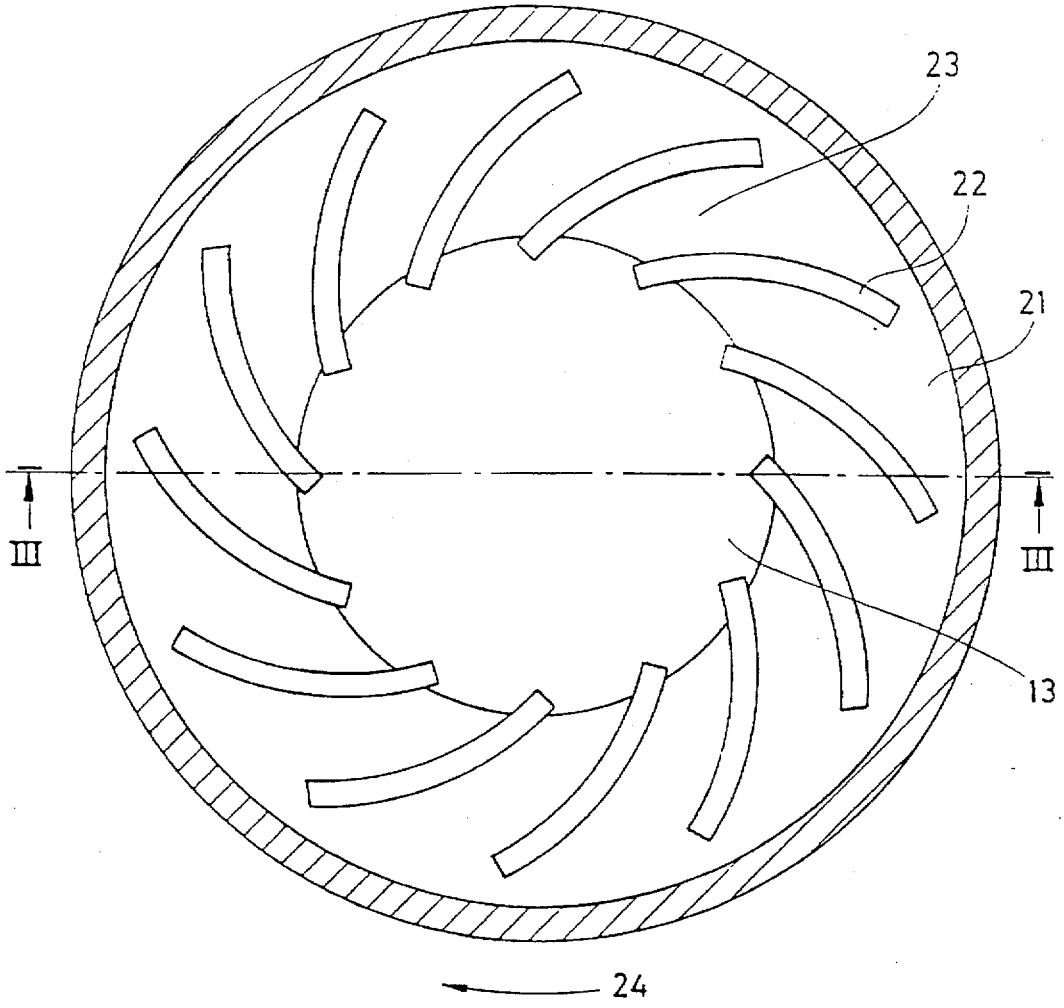

From FIG. 2, which schematically shows a section along the line II—II through a part of the centrifugal separator shown in FIG. 1, the design of the wall elements 22 arranged on the dividing wall 21 and how they form channels 23 between themselves is more apparent. Each wall element 22 is directed in a way such that it has a directional component in the circumferential direction which seen radially outwardly is directed forwardly in the rotational direction. The rotational direction is clockwise, which is indicated with the arrow 24. In addition, the wall elements 22 are curved in a plane perpendicular to the rotational axis and has a directional component in the circumferential direction that increases with the radius.

Figure 3:
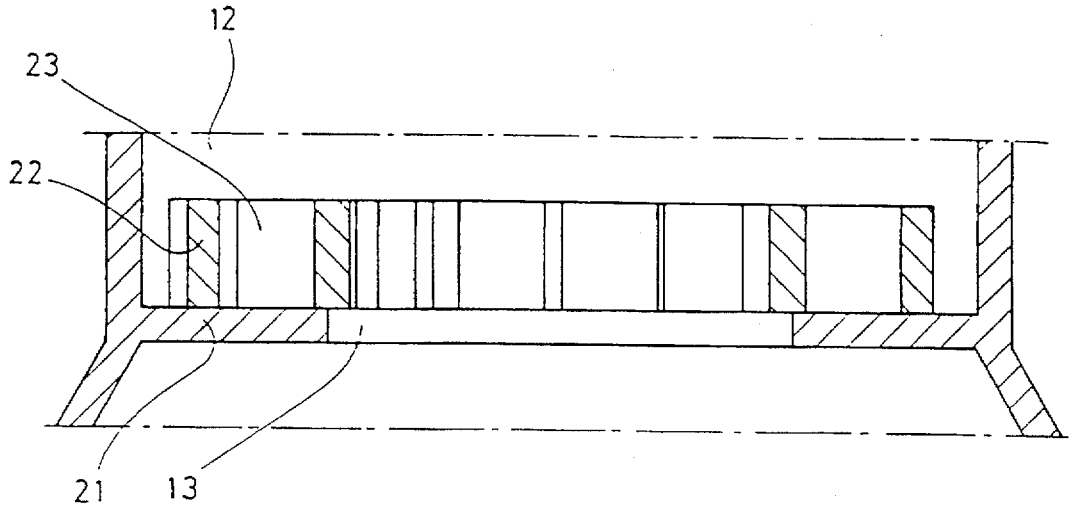

FIG. 3 shows an axial section through the portion shown in FIG. 2. The channels 23 shown in FIG. 1, 2 and 3 have a cross section, which axially in the direction towards the outlet 19 is open towards the outlet chamber 12.

Figure 4:
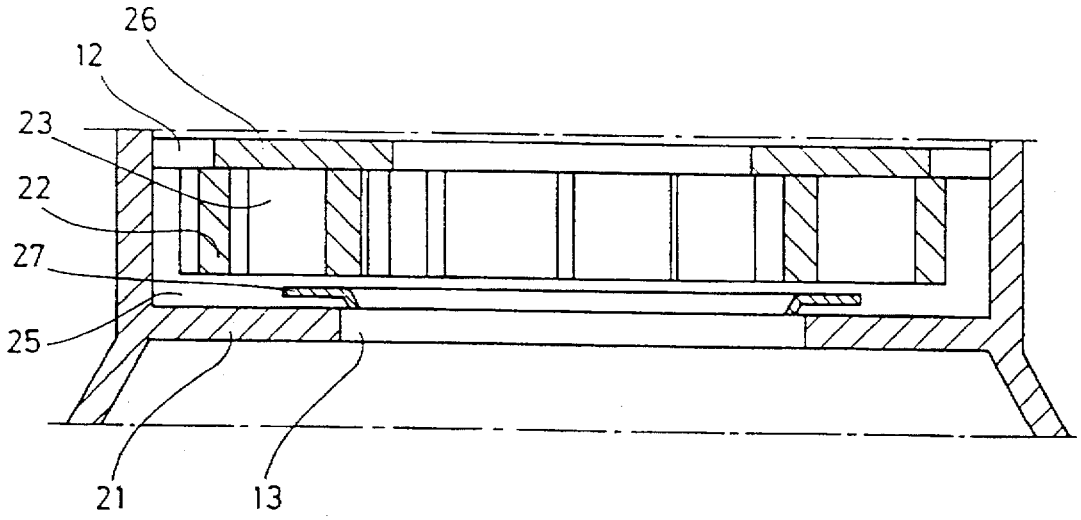

Another embodiment of the portion of the centrifugal separator according to the invention shown in the FIGS. 2 and 3 is shown in FIG. 4. As in FIG. 3, FIG. 4 shows an axial section through the portion. The embodiment according to FIG. 4 differs from the embodiment shown in FIGS. 1, 2 and 3 in that the wall elements 22 are arranged at an axial distance from the dividing wall 21 in a way such that a gap 25 is formed between them. In addition, a covering device 26 is arranged fixedly connected to each one of the wall elements 22 on the side of them, which is turned from the dividing wall 21. Furthermore, an annular baffle 27 surrounding the rotational axis is arranged at the passage 13. This baffle conducts the separated liquid radially outwardly in the gap towards the free liquid surface in a way such that it does not collide with the parts of the wall elements 22 located radially inside the free liquid surface during the flow radially outwardly.

Upon start of the centrifugal separator the rotor is rotated and the separation chamber 5 is closed by supplying a closing liquid to the closing chamber 7 through the inlet 8. When the separation chamber 5 is closed the liquid, which is to be centrifugally treated, can be supplied to the separation chamber through the inlet tube 15 and the inlet chamber 16. Eventually the separation chamber 5 is filled up, the rotor obtains an operational number of revolutions and the conditions are stabilized inside the separation chamber. The components in the supplied liquid are separated during the influence of the centrifugal forces acting on the same.

The separation is then mainly taking place in the spaces between the conical discs in the disc stack 10. During the separation the specific heavier component is thrown radially outwardly and is collected at the radially outermost part of the separation chamber, whereas a specific lighter liquid flows radially inwardly in these spaces.

The specific heavier component is discharged intermittently during operation by having the valve slide 4 to uncover the peripheral outlet openings 6 during time periods.

The specific lighter liquid flows out of the separation chamber 5 through passages 13 to the outlet chamber 12, in which it forms a rotational liquid body with a radially inwardly directed free liquid surface. The liquid present in the outlet chamber 12 is discharged through the outlet 19 and further out through the outlet channel 20 in the stationary outlet device 18.

The entrainment of the liquid component present in the outlet chamber 12 is effected by means of the wall elements 22 rotating with the rotor and by means of the delimiting surfaces of the outlet chamber.

The liquid located closest to the outlet device 18 is slown down by the contact with the outlet surfaces of the outlet device 18. Different portions of the liquid volume present in the outlet chamber 12 will thereby obtain different rotational speeds. The contact between the liquid and the outer surfaces of the outlet device 18 means that the circulating flow is generated in the outlet chamber 20, the liquid, as mentioned above, is flowing radially inwardly along the outlet surfaces of the outlet device 18 and is flowing radially outwardly towards the outlet mainly along the rear wall element of the two wall elements which form the channel, seen in the rotational direction. The air or gas which has been mixed into and been entrained in the separated liquid in its flowing along these wall elements has an essential lower density than the separated liquid. This results in the entrained air or gas bubbles being exposed to a relatively high radially inwardly directed force towards the front wall element of the two elements forming the channel, seen in the rotational direction. The air or gas bubbles will thereby leave the rear wall element and flow towards and be collected at the front wall element along which they flow further radially inwardly towards the free liquid surface without being influenced by the radially outwardly directed shearing forces from the radially outwardly flowing separated liquid, whereby most of the air or gas, which has been mixed in and been entrained in the separated liquid is separated out of the same before the liquid reaches the outlet out of the outlet chamber.

This effect is also achieved by the present invention if the passage as shown in the figures is arranged radially inside the free liquid surface, which in many cases is desirable to achieve a good separating result but results in an increase of the radially outwardly directed flow.

The invention claimed is:

1. A centrifugal separator comprising a rotor, which is rotatable around a rotational axis and inside itself forms an inlet chamber for a liquid to be centrifugally treated, an separation chamber, which is connected to the inlet chamber, and an outlet chamber, which via a passage communicates with the separation chamber for the reception of a liquid separated during operation in the separation chamber, the outlet chamber being so formed inside the rotor that a liquid present therein during operation forms a rotating liquid body with a radially inwardly directed free liquid surface, and which outlet chamber is provided with an outlet radially outside the free liquid surface, at least two wall elements extending radially and axially being arranged in the outlet chamber fixedly connected to the rotor and arranged to form a channel between the wall elements to entrain during operation the separated liquid into the rotation of the rotor and at the same time admit a flow of the separated liquid radially outwardly in the outlet chamber, characterized in that each one of the wall elements at least has a portion, which extends radially between the radial level at which the free liquid surface is located and a radial level radially outside the outlet, each said portion of the wall elements having a directional component in the circumferential direction, which seen radially outwardly is directed forwardly in the rotational direction of said rotor.

2. A centrifugal separator according to claim 1, characterized in that said portion of the wall elements is curved in a plane perpendicular to the rotational axis and has a directional component in the circumferential direction that increases with increasing radius.

3. A centrifugal separator according to claim 2, characterized in that the channel has a cross section, which, in a direction towards the outlet, is open axially towards the outlet chamber.

4. A centrifugal separator according to claim 2 characterized in that said outlet is formed in a stationary outlet device, the outlet device extending into the outlet chamber to a radial level, which during operation is located radially outside the free liquid surface.

5. A centrifugal separator according to claim 2, characterized by a dividing wall, which is arranged to separate the outlet chamber from the separation chamber, the passage being arranged through the dividing wall.

6. A centrifugal separator according to claim 1, characterized by a dividing wall, which is arranged to separate the outlet chamber from the separation chamber, the passage being arranged through the dividing wall.

7. A centrifugal separator according to claim 6, characterized in that the passage is arranged radially inside the free liquid surface.

8. A centrifugal separator according to claim 7 characterized in that the wall elements have a first axial side facing in a first direction towards the dividing wall and a second axial side facing in a second direction opposite the first direction, a covering device being arranged in the outlet chamber fixedly connected to each one of the wall elements on said second axial side to delimit the channel towards the outlet chamber at the first side of the wall elements.

9. A centrifugal separator according to claim 7, characterized in that the wall elements are fixed onto the dividing wall.

10. A centrifugal separator according to claim 9, characterized in that an annular gap surrounding the rotational axis is arranged axially between the dividing wall and the wall elements.

11. A centrifugal separator according to claim 7, characterized in that the channel has a cross section, which, in a direction towards the outlet, is open axially towards the outlet chamber.

12. A centrifugal separator according to claim 6, characterized in that the wall elements are fixed onto the dividing wall.

13. A centrifugal separator according to claim 12, characterized in that the channel has a cross section, which, in a direction towards the outlet, is open axially towards the outlet chamber.

14. A centrifugal separator according to claim 12 characterized in that the wall elements having a first axial side facing in a first direction towards the dividing wall and a second axial side facing in a second direction opposite the first direction, a covering device being arranged in the outlet chamber fixedly connected to each one of the wall elements on said second axial side to delimit the channel towards the outlet chamber at the first side of the wall elements.

15. A centrifugal separator according to claim 6, characterized in that an annular gap surrounding the rotational axis is arranged axially between the dividing wall and the wall elements.

16. A centrifugal separator according to claim 15, characterized by an annular baffle, which is arranged in the outlet chamber and extends radially outwardly from the passage out into the gap.

17. A centrifugal separator according to claim 16 characterized in that the wall elements having a first axial side facing in a first direction towards the dividing wall and a second axial side facing in a second direction opposite the first direction, a covering device being arranged in the outlet chamber fixedly connected to each one of the wall elements on said second axial side to delimit the channel towards the outlet chamber at the first side of the wall elements.

18. A centrifugal separator according to claim 15, characterized in that the channel has a cross section, which, in a direction towards the outlet, is open axially towards the outlet chamber.

19. A centrifugal separator according to claim 15 characterized in that the wall elements having a first axial side facing in a first direction towards the dividing wall and a second axial side facing in a second direction opposite the first direction, a covering device being arranged in the outlet chamber fixedly connected to each one of the wall elements on said second axial side to delimit the channel towards the outlet chamber at the first side of the wall elements.

20. A centrifugal separator according to claim 6, characterized in that the channel has a cross section, which, in a direction towards the outlet, is open axially towards the outlet chamber.

21. A centrifugal separator according to claim 1, characterized in that the channel has a cross section, which, in a direction towards the outlet, is open axially towards the outlet chamber.

22. A centrifugal separator according to claim 1 characterized in that said outlet is formed in a stationary outlet device, the outlet device extending into the outlet chamber to a radial level, which during operation is located radially outside the free liquid surface.

* * * * *

UNITED STATES PATENT AND TRADEMARK OFFICE

CERTIFICATE OF CORRECTION

PATENT NO. : 5,709,643

DATED : 01/20/98

INVENTOR(S) : Borgstrom et al.

It is certified that error appears in the above-identified patent and that said Letters Patent is hereby corrected as shown below:

Col. 2, line 43, change "angular" to --annular--.

Col. 3, line 24, delete "in" after --its--.

Signed and Sealed this

Seventh Day of April, 1998

Bruce Lehman

*Attest:*

BRUCE LEHMAN

*Attesting Officer*

*Commissioner of Patents and Trademarks*